US009771242B2

(12) United States Patent
Kattainen et al.

(10) Patent No.: US 9,771,242 B2
(45) Date of Patent: Sep. 26, 2017

(54) INSPECTION TESTS FOR AN ELEVATOR WITHOUT ADDITIONAL TEST WEIGHTS

(71) Applicants: Ari Kattainen, Hyvinkaa (FI); Lauri Stolt, Helsinki (FI)

(72) Inventors: Ari Kattainen, Hyvinkaa (FI); Lauri Stolt, Helsinki (FI)

(73) Assignee: Kone Corporation, Helsinki (FI)

( * ) Notice: Subject to any disclaimer, the term of this patent is extended or adjusted under 35 U.S.C. 154(b) by 262 days.

(21) Appl. No.: 14/491,097

(22) Filed: Sep. 19, 2014

(65) Prior Publication Data

US 2015/0114765 A1 Apr. 30, 2015

(30) Foreign Application Priority Data

Oct. 25, 2013 (EP) ..... 13190233

(51) Int. Cl.
*B66B 5/00* (2006.01)

(52) U.S. Cl.
CPC ..... *B66B 5/0087* (2013.01); *B66B 5/0037* (2013.01)

(58) Field of Classification Search
CPC ..... B66B 5/0037; B66B 5/0087
See application file for complete search history.

(56) References Cited

U.S. PATENT DOCUMENTS 5,260,527 A * 11/1993 Sirag, Jr. ..... B66B 1/2408 187/380
5,531,294 A * 7/1996 Burton ..... B66B 1/28 187/292
6,325,179 B1 12/2001 Barreiro et al.
7,350,883 B2 * 4/2008 Hubbard ..... B66B 5/0018 187/393
8,162,110 B2 * 4/2012 Smith ..... B66B 1/3484 187/266
9,061,864 B2 * 6/2015 Spirgi ..... B66B 5/0037
(Continued)

FOREIGN PATENT DOCUMENTS

DE 102007015648 A1 6/2008
WO WO 2007094777 A2 * 8/2007 ..... B66B 5/0093
WO WO-2007094777 A2 8/2007

OTHER PUBLICATIONS

Carsten Schumann, "Alternative Weightless Testing: An Overview", Elevator World, Sep. 2012, pp. 120-124.
(Continued)

*Primary Examiner* — William E Dondero
*Assistant Examiner* — Diem Tran
(74) *Attorney, Agent, or Firm* — Harness, Dickey & Pierce, P.L.C.

(57) ABSTRACT

The invention allows inspection tests for an elevator without additional test weights. An empty elevator car and its counterweight are balanced by filling in weight pieces to the counterweight. 100% load of the elevator car in regard to unbalance is configured by moving unused counterweight pieces inside the elevator car. Inspection tests requiring the 100% load in regard to unbalance are performed. 125% load of the elevator car is simulated with 50% load and 125% speed of the elevator car. Inspection tests requiring the 125% load in regard to unbalance are performed. A final counterweight is configured by moving its weight pieces from the elevator car to the counterweight. Inspection tests requiring the final counterweight are performed.

9 Claims, 1 Drawing Sheet

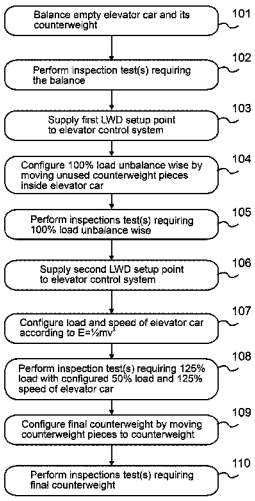

(56) References Cited

U.S. PATENT DOCUMENTS

| | | | | |
|---|---|---|---|---|
| 2010/0154527 | A1 | 6/2010 | Illan | |
| 2015/0114765 | A1* | 4/2015 | Kattainen | B66B 5/0087 187/405 |

OTHER PUBLICATIONS

John Koshak, "Saefty and Buffering Testing without Weights", Elevator World, Sep. 2010, pp. 129-143.

Dr. Lutfi Al-Sharif, "Die Überprüfung von Aufzugs-Fangvorrichtungen ohne Prüfgewichte-Kritik und Überblick", Lift Report, VFZ Verlag, Dortmunt, DE, vol. 28, No. 5, Sep. 2002, pp. 16-23.

European Search Report for Application No. EP 13190233 dated May 14, 2014.

* cited by examiner

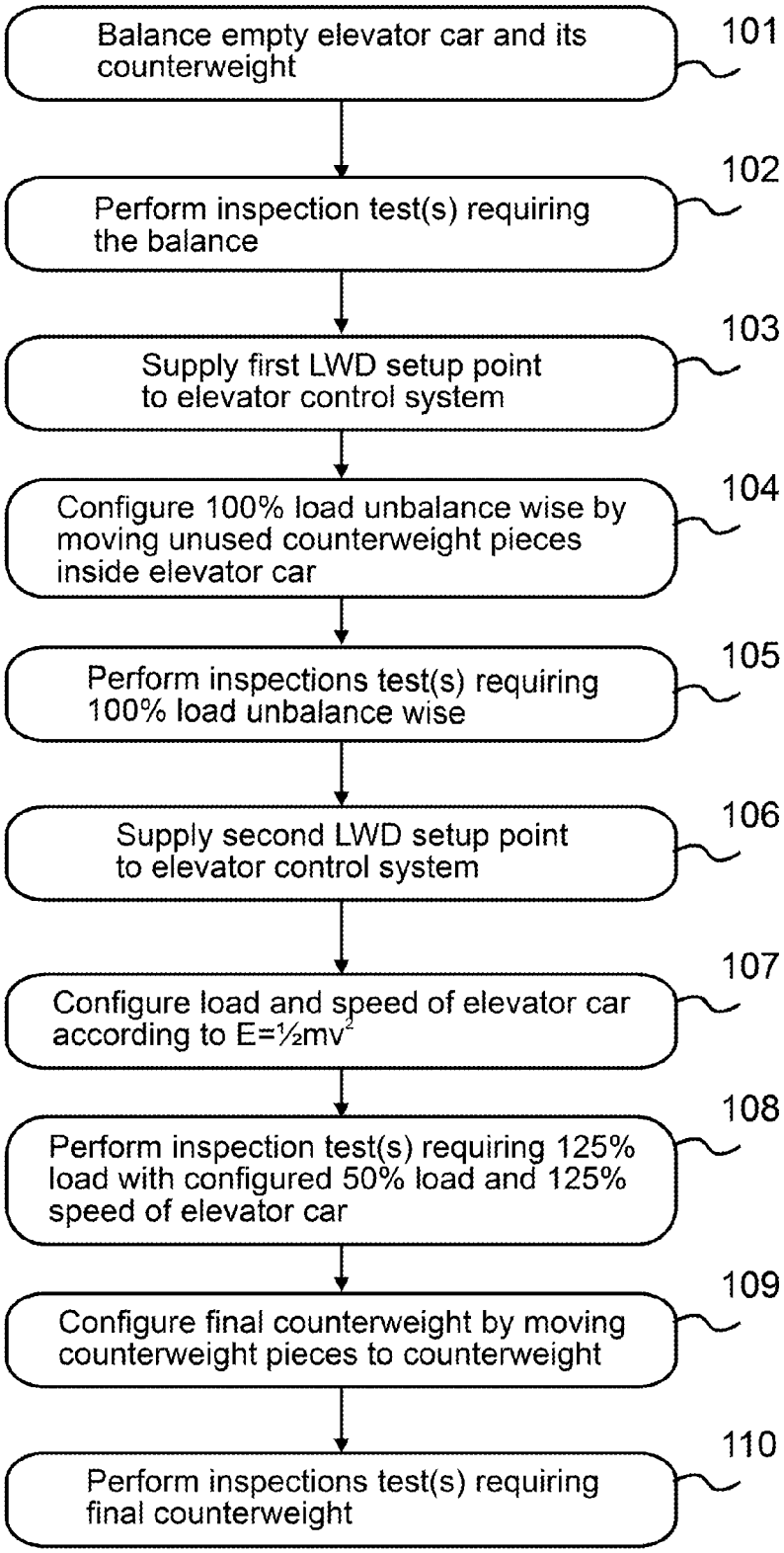
Balance empty elevator car and its counterweight
101
Perform inspection test(s) requiring the balance
102
Supply first LWD setup point to elevator control system
103
Configure 100% load unbalance wise by moving unused counterweight pieces inside elevator car
104
Perform inspections test(s) requiring 100% load unbalance wise
105
Supply second LWD setup point to elevator control system
106
Configure load and speed of elevator car according to E=½mv²
107
Perform inspection test(s) requiring 125% load with configured 50% load and 125% speed of elevator car
108
Configure final counterweight by moving counterweight pieces to counterweight
109
Perform inspections test(s) requiring final counterweight
110

INSPECTION TESTS FOR AN ELEVATOR WITHOUT ADDITIONAL TEST WEIGHTS

This application claims priority to European Patent Application No. EP13190233 filed on Oct. 25, 2013, the entire contents of which are incorporated herein by reference.

BACKGROUND OF THE INVENTION

Field of the Invention

The invention relates to inspection tests for an elevator. In particular, the invention relates to inspection tests for an elevator without additional test weights.

Description of the Related Art

Inspection tests for an elevator, such as installation tests and periodic or scheduled maintenance tests, are traditionally performed utilizing additional test weights. Here, "additional" means that these test weights are not part of the elevator system in regular use. Instead, the test weights are delivered to the test site from storage for the duration of the inspection tests and then returned. Such delivery distances may be long. Accordingly, delivering the test weights to the test site and back takes time and incurs costs. Furthermore, they expose test/delivery personnel to injuries.

Therefore, an object of the present invention is to alleviate the problems described above and to introduce a solution that allows inspection tests for an elevator car without additional test weights.

SUMMARY OF THE INVENTION

An aspect of the present invention is a method of performing inspection tests for an elevator without additional test weights. The method comprises:

a) balancing an empty elevator car and its counterweight by filling in weight pieces to the counterweight until the balance is achieved;

b1) configuring a 100% load of the elevator car in regard to unbalance by moving unused weight pieces of the counterweight inside the elevator car until unbalance between the elevator car and its counterweight is equal to that with a final counterweight, and performing at least one inspection test requiring the 100% load of the elevator car in regard to unbalance, b2) for tests requiring a predetermined overload and rated speed of the elevator car, configuring the load and speed of the elevator car according to:

$$E=\tfrac{1}{2}mv^2,$$

wherein E represents kinetic energy, m represents mass, and s represents speed, of the elevator car, such that substantially equal kinetic energy is achieved by utilizing overspeed of the elevator car instead of the predetermined overload of the elevator car, and performing at least one inspection test requiring the predetermined overload of the elevator car with the configured load and speed of the elevator car; and c) configuring a final counterweight by moving its weight pieces to the counterweight, and performing at least one inspection test requiring the final counterweight.

In an embodiment of the invention, in b2) the required predetermined overload is a 125% load, the configured load of the elevator car is a 50% load, and the configured speed of the elevator car is 125% speed.

In an embodiment of the invention, the inspection tests include at least one of installation tests and periodic maintenance tests. At least one of the installation tests and periodic maintenance tests may include at least one of a braking system test, a traction check, a car safety gear test, a buffer test, and an unintended car movement protection means test.

In an embodiment of the invention, a) further includes supplying a first load weighing device setup point to a control system associated with the elevator car. Here, in case of a car of a top machinery elevator, the first load weighing device setup point may correspond to a 0% load, and in case of a car of a pit machinery elevator, the first load weighing device setup point may correspond to a 50% load.

In an embodiment of the invention, b1) further includes supplying a second load weighing device setup point to the control system associated with the elevator car. Here, in case of a car of a top machinery elevator, the second load weighing device setup point may correspond to a 50% load, and in case of a car of a pit machinery elevator, the second load weighing device setup point may correspond to a 100% load.

In an embodiment of the invention, a) further includes performing at least one inspection test requiring such the balance.

It is to be understood that the aspects and embodiments of the invention described above may be used in any combination with each other. Several of the aspects and embodiments may be combined together to form a further embodiment of the invention. A method which is an aspect of the invention may comprise at least one of the embodiments of the invention described above.

The invention allows inspection tests for an elevator without additional test weights. This in turn allows reducing costs associated with these inspection tests as well as reduces time needed due to no need to deliver test weights to a test site and back anymore.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings:

FIG. 1 is a flow chart illustrating a method according to an embodiment of the present invention.

DETAILED DESCRIPTION OF THE INVENTION

Reference will now be made in detail to the embodiments of the present invention, examples of which are illustrated in the accompanying drawings.

FIG. 1 is a flow chart illustrating a method of performing inspection tests for an elevator without additional test weights according to an embodiment of the present invention.

At step 101, an empty elevator car and its counterweight are balanced by filling in weight pieces to the counterweight until balance is achieved between the empty elevator car and its counterweight. Let us assume an example elevator car, wherein the empty elevator car weighs 500 kg, its rated load is 630 kg, and its counterweight weighs 815 kg with a 50% balancing. As is known in the art, the term "50% balancing" refers to the weight of the counterweight being substantially equal to the weight of the elevator car plus 50% of the rated load of the elevator car, i.e. 815 kg=500 kg+(630 kg/2), with our example elevator car. Since the empty elevator car of our example weighs 500 kg, weight pieces are added to the counterweight until it also weighs 500 kg to achieve balance between the empty elevator car and its counterweight. In other words, 315 kg of the weight pieces of the counterweight are left unused for steps 101-103.

At optional step 102, at least one inspection test requiring such a balance is performed. The inspection test(s) may include at least one of installation tests or initial acceptance tests and periodic maintenance tests and verifications. At least one of the installation tests and periodic maintenance tests may include at least one of a braking system test, a traction check, a car safety gear test, a buffer test, and an unintended car movement protection means test.

At optional step 103, a first load weighing device setup point is supplied to a control system associated with the elevator car. Here, in case of a car of a top machinery elevator, the first load weighing device setup point may correspond to a 0% load, and in case of a car of a pit machinery elevator, the first load weighing device setup point may correspond to a 50% load.

Herein, a top machinery elevator refers to an elevator system in which the load weighing device measuring the elevator car load (i.e. the mass of passenger(s) and/or object(s)) is located at the top of the hoistway at an attachment point of hoisting ropes thereby measuring the suspension of the hoisting ropes. A hoist machine and its associated brake are also located at the top of the hoistway. In other words, the elevator car is hanging between the load weighing device and the hoist machine brake. Accordingly, the mass of the counterweight has no effect on the mass indicated by the load weighing device since the counterweight is effectively behind the hoist machine. This is why the first load weighing device setup point may correspond to a 0% load in case of the top machinery elevator, as discussed above.

Herein, a pit machinery elevator refers to an elevator system equipped with cogged belt pull between the counterweight and the elevator car (with the hoist machine and its associated brake in between), and in which the load weighing device measuring the elevator car load is located in the pit of the hoistway together with the hoist machine and its associated brake. Accordingly, the load weighing device indicates or measures the unbalance between the elevator car and the counterweight, i.e. the differential of the rope forces over the drive sheave. Therefore, in step 101, torque of the hoist machine brake is 0, which corresponds to a 50% load in actual use. This is why the first load weighing device setup point may correspond to a 50% load in case of the pit machinery elevator, as discussed above.

In other words, the load weighing device setup points depend on the location of the load weighing device. For example, in yet another elevator system, the load weighing device may be located on the roof of the elevator car when the suspension factor is 1:1.

At step 104, a 100% load of the elevator car in regard to unbalance is configured by moving unused weight pieces of the counterweight inside the elevator car until unbalance between the elevator car and its counterweight is equal to that with a final counterweight. With our example elevator car, the previously unused 315 kg of the weight pieces of the counterweight are moved inside the elevator car resulting in the elevator car+its load weighing 500 kg+315 kg=815 kg. The counterweight still weighs 500 kg. In other words, the unbalance between the loaded elevator car and its counterweight is now 315 kg which is equal to the situation with the final counterweight (elevator car of 500 kg and its counterweight of 815 kg). From the point of view of a braking system (i.e. in regard to unbalance), this corresponds to a 100% load.

At step 105, at least one inspection test requiring the configured 100% load of the elevator car in regard to unbalance is performed.

At optional step 106, a second load weighing device setup point is supplied to the control system associated with the elevator car. Here, in case of a car of a top machinery elevator, the second load weighing device setup point may correspond to a 50% load, and in case of a car of a pit machinery elevator, the second load weighing device setup point may correspond to a 100% load.

Also, at this point, performance of an overload device may be tested in case of a pit machinery elevator. For example, when a person over 63 kg enters the car, the overload needs to be indicated.

At step 107, for tests requiring a predetermined overload and rated speed of the elevator car, the load and speed of the elevator car are configured according to Equation (1):

$$E=\tfrac{1}{2}mv^2, \tag{1}$$

wherein E represents kinetic energy, m represents mass, and s represents speed, of the elevator car, such that substantially equal kinetic energy is achieved by utilizing overspeed of the elevator car instead of the predetermined overload of the elevator car.

At step 108, at least one inspection test requiring the predetermined overload of the elevator car is performed with the configured load and speed of the elevator car. Here, in case the required predetermined overload is a 125% load, the configured load of the elevator car may be a 50% load, and the configured speed of the elevator car may be 125% speed. With our example elevator car, the kinetic energy of the elevator car with 125% load (i.e. approx. 1288 kg=500 kg+(1.25×630 kg)) and rated speed (i.e. 100% speed) of 1 m/s can be calculated as follows:

$$E=\tfrac{1}{2}mv^2=0.5\times1288\text{ kg}\times1\text{ m/s}\times1\text{ m/s}=4024\text{ Joule}$$

However, as a result of steps 104-106, our example elevator car with its load currently weighs 815 kg. This would need to be multiplied with 1.58 to achieve the required 125% load. On the other hand, to achieve substantially equal kinetic energy, we can instead increase the speed by 25%:

$$E=\tfrac{1}{2}mv^2=0.5\times815\text{ kg}\times1.25\text{ m/s}\times1.25\text{ m/s}=4043\text{ Joule}$$

Accordingly, with 125% speed and 50% (i.e. 630 kg/2=315 kg) load in the car, we can simulate the situation of 125% load and rated speed since the kinetic energies will be substantially equal (4024 Joule vs. 4043 Joule), as shown above.

This arrangement can be utilized e.g. to check that suspensions and rope attachments are in order. Furthermore, this arrangement can be utilized e.g. to check that the braking system, the safety gear and the buffer are able to absorb enough kinetic energy.

At step 109, a final counterweight is configured by moving its weight pieces from the elevator car to the counterweight. With our example elevator car, the 315 kg of the weight pieces of the counterweight inside the elevator car until now are moved to the counterweight resulting in the final counterweight of 815 kg. Here, the term "final" refers to whatever weight the counterweight has been rated for when the elevator system is in use. As discussed above, with our example elevator car, the counterweight is to weigh 815 kg when the elevator system is in use. At step 110, at least one inspection test requiring the final counterweight is performed.

The following discusses examples of how to implement tests in European Standard EN 81-1, Annex D utilizing the present invention:

For the braking system, EN 81-1, Annex D defines:

"the test shall be carried out whilst the car is descending at rated speed with 125% of the rated load and interrupting the supply to the motor and the brake".

With the present invention, this can be performed in steps 104-108 of FIG. 1. With one brake, an emergency stop is executed with rated unbalancing and rated speed. Both brakes are testes separately. Deceleration distance and average deceleration are measured separately based e.g. on measurement data provided by a door zone sensor and a machine encoder. With two brakes, an emergency stop is executed with rated unbalancing and with speed that corresponds to the kinetic energy of the method defined in EN 81-1, Annex D, i.e. approximately 125% speed, as discussed above. Deceleration distance and average deceleration are measured separately based e.g. on measurement data provided by a door zone sensor and a machine encoder.

For traction, EN 81-1, Annex D defines:

"the traction shall be checked by making several stops with the most severe braking compatible with the installation. At each test, complete stoppage of the car shall occur;

the test shall be carried out:

a) ascending, with the car empty, in the upper part of the travel;

b) descending, with the car loaded with 125% of the rated load, in the lower part of the travel".

With the present invention, portion b) can be tested in steps 107-108 of FIG. 1. Portion a) can be tested in steps 109-110 of FIG. 1 with the final counterweight.

For traction, EN 81-1, Annex D further defines:

"it will be checked that the empty car cannot be raised, when the counterweight rests on its compressed buffer".

With top machinery elevators, the test can be executed with an empty car in steps 109-110 of FIG. 1 with the final counterweight.

For balancing, EN 81-1, Annex D defines:

"it shall be checked that the balance is as stated by the installer; this check can be made by means of measurements of current combined with:

a) speed measurements for A.C. motors;

b) voltage measurements for D.C. motors".

This test can be executed in steps 109-110 of FIG. 1.

For progressive safety gear, EN 81-1, Annex D defines:

"progressive safety gear:

the car shall be loaded with 125% of the rated load, and travel at rated speed or lower.

When the test is made with lower than rated speed, the manufacturer shall provide curves to illustrate the behaviour of the type tested progressive safety gear when dynamically tested with the suspensions attached.

After the test, it shall be ascertained that no deterioration, which could adversely affect the normal use of the lift has occurred. If necessary, friction components may be replaced. Visual check is considered to be sufficient".

This test can be executed in steps 107-108 of FIG. 1 with the 125% speed in the manner discussed above in connection with steps 107-108, thereby simulating the kinetic energy required in the Annex D test.

For buffers, EN 81-1, Annex D defines:

"energy accumulation type buffers with buffered return movement and energy dissipation type buffers:

the test shall be made in the following manner: the car with its rated load and the counterweight shall be brought into contact with the buffers at the rated speed or at the speed for which the stroke of the buffers has been calculated, in the case of the use of reduced stroke buffers with verification of the retardation (10.4.3.2).

After the test, it shall be ascertained that no deterioration, which could adversely affect the normal use of the lift has occurred. Visual check is considered to be sufficient".

The car buffer test can be executed in steps 107-108 of FIG. 1 with the 125% speed in the manner discussed above in connection with steps 107-108, thereby simulating the kinetic energy required in the Annex D test. The counterweight buffer test, if needed, can be executed in steps 109-110 of FIG. 1 with rated speed.

For unintended car movement protection means, EN 81-1, Annex D defines:

"The test shall:

consist of verifying that the stopping element of the means is triggered as required by type examination;

be made by moving the empty car in up direction in the upper part of the well (e.g. from one floor from top terminal) and fully loaded car in down direction in the lower part of the well (e.g. from one floor from bottom terminal) with a 'preset' speed, e.g. as defined during type testing, (inspection speed etc.)".

"The fully loaded car in down direction in the lower part of the well" can be tested in steps 104-108 of FIG. 1.

For an overload device, the following actions can be performed according to an embodiment of the present invention:

the car and its counterweight are balanced after installation. This is input to the drive which records the value given by a load weighing device sensor to correspond to a 50% load.

when counterweight pieces are inside the car simulating the 100% load in regard to unbalance, this is input to the drive which records the value given by a load weighing device sensor to correspond to a 100% load.

when the counterweight has been configured to its final weight and the car is empty, this is input to the drive which records the value given by a load weighing device sensor to correspond to a 0% load.

Now, the overload device can be tested in steps 104-108 of FIG. 1 with e.g. an additional load consisting of one person.

If desired, the different functions discussed herein may be performed in a different order and/or concurrently with each other.

While the present inventions have been described in connection with a number of exemplary embodiments, and implementations, the present inventions are not so limited, but rather cover various modifications, and equivalent arrangements, which fall within the purview of prospective claims.

The invention claimed is:

1. A method of performing inspection tests for an elevator, the elevator including an elevator car and a counterweight, the elevator car having a rated load associated therewith, the counterweight including a plurality of removable pieces, the method comprising:

balancing the elevator car and the counterweight when the elevator car is empty by incorporating first ones of the plurality of removable pieces into the counterweight such that a weight of the counterweight is same as a weight of the elevator car when the elevator car is empty;

adjusting the weight of the elevator car to the rated load of the elevator car by placing second ones of the plurality of removable pieces inside the elevator car such that the weight of the elevator car is equal to the rated load of the elevator car;

simulating overloading the elevator car beyond the rated load by increasing a velocity of the elevator car while the weight of the elevator car is less than the rated load;

performing at least one inspection test associated with the simulated overload; and configuring the counterweight for normal elevator operation by incorporating each of the second ones of the plurality of removable pieces into the counterweight to set the counterweight to a final state, and performing at least one inspection test associated with the final state of the counterweight.

2. The method according to claim 1, wherein in the simulating overloading includes simulating 125% of the rated load while the weight of the elevator is is 50% of the rated load by setting the velocity of the elevator car is to 125% a rated velocity.

3. The method according to claim 1, wherein the inspection tests include at least one of installation tests and periodic maintenance tests.

4. The method according to claim 3, wherein at least one of the installation tests and periodic maintenance tests includes at least one of a braking system test, a traction check, a car safety gear test, a buffer test, and an unintended car movement protection means test.

5. The method according to claim 1, wherein the method further comprises:

supplying a first load weighing device setup point to a control system associated with the elevator car, the first load weighing device setup point being based on a location of a load weighing device associated with the elevator.

6. The method according to claim 5, wherein, in case of a car of a top machinery elevator, the first load weighing device setup point corresponds to a 0% load, and in case of a car of a pit machinery elevator, the first load weighing device setup point corresponds to a 50% load.

7. The method according to claim 1, the method further comprises:

supplying a second load weighing device setup point to the control system associated with the elevator car, the first load weighing device setup point being based on a location of a load weighing device associated with the elevator.

8. The method according to claim 7, wherein, in case of a car of a top machinery elevator, the second load weighing device setup point corresponds to a 50% load, and in case of a car of a pit machinery elevator, the second load weighing device setup point corresponds to a 100% load.

9. The method according to claim 1, further comprising:

performing at least one inspection test when the balancing balances the weight of the counterweight and the weight of the elevator car when the elevator car is empty.

* * * * *